US009199703B1

(12) United States Patent
Svendsen

(10) Patent No.: US 9,199,703 B1
(45) Date of Patent: Dec. 1, 2015

(54) MARINE VESSEL SLIDING DOOR SYSTEM AND METHOD

(71) Applicant: Joel Svendsen, Miami Lakes, FL (US)

(72) Inventor: Joel Svendsen, Miami Lakes, FL (US)

( * ) Notice: Subject to any disclaimer, the term of this patent is extended or adjusted under 35 U.S.C. 154(b) by 112 days.

(21) Appl. No.: 13/933,423

(22) Filed: Jul. 2, 2013

Related U.S. Application Data

(60) Provisional application No. 61/667,526, filed on Jul. 3, 2012.

(51) Int. Cl.

| | |
|---|---|
| ***B63B 19/18*** | (2006.01) |
| ***B63B 43/26*** | (2006.01) |
| ***B63B 19/00*** | (2006.01) |
| ***B63B 27/14*** | (2006.01) |

(52) U.S. Cl.
CPC ..... *B63B 43/26* (2013.01); *B63B 19/00* (2013.01); *B63B 27/14* (2013.01)

(58) Field of Classification Search
CPC ..... B63B 19/08; B63B 27/14; B63B 19/00; B63B 2019/083; B63B 2019/086; B63B 19/18; B63B 43/26
USPC ..... 49/404–459; 114/362, 364, 116–120
See application file for complete search history.

(56) References Cited

U.S. PATENT DOCUMENTS

| | | | | |
|---|---|---|---|---|
| 5,105,755 | A * | 4/1992 | Davidson | 114/343 |
| 5,224,297 | A * | 7/1993 | Watkins | 49/449 |
| 7,004,101 | B1 * | 2/2006 | Mardikian | 114/362 |
| 8,429,853 | B2 * | 4/2013 | Martin | 49/41 |

* cited by examiner

*Primary Examiner* — S. Joseph Morano
*Assistant Examiner* — Andrew Polay
(74) *Attorney, Agent, or Firm* — H. John Rizvi; Gold & Rizvi, P.A.

(57) ABSTRACT

A gunwale sliding section is integrated into a stern portion of a gunwale of a marine vessel. The gunwale sliding section is slideably positioned. The longitudinal motion of the gunwale sliding section is parallel to the gunwale, wherein a sternward motion provides an open configuration and bow-ward motion provides a closed configuration. A rail and slide assembly enables the sliding motion. The stern arrangement of the gunwale sliding section enables a wider span across the opening, thus enhancing embarking and disembarking of the marine vessel. The gunwale sliding section can be manually operated or employ automated mechanisms, such as a hydraulic system, a pneumatic system, a motor driven system, and the like.

19 Claims, 12 Drawing Sheets

MARINE VESSEL SLIDING DOOR SYSTEM AND METHOD

CROSS-REFERENCE TO RELATED APPLICATION

This Non-Provisional Utility application claims the benefit of U.S. Provisional Patent Application Ser. No. 61/667,526, filed on Jul. 3, 2012, which is incorporated herein in its entirety.

FIELD OF THE INVENTION

The present invention relates to a marine vessel sliding gunwale system and method of use, and more particularly, a marine vessel sliding gunwale system useful for a vessel having a sliding door gunwale that can be easily opened, and provide a broad passageway enabling easy egress for passengers and cargo.

BACKGROUND OF THE INVENTION

Dimensions of an opening through a gunwale governs the accessibility of an individual and passage of cargo between a dock and a deck of a marine vessel. The passageway is limited by a height of the opening and a width of the opening. The height is limited by the distance between decks. The width is limited by the horizontal distance across the opening. The opening is commonly governed by the respective size of a doorway. Most doorways are designed to accommodate a width of a wheelchair bound individual. Although this width is generally acceptable, it is not accommodating all circumstances.

Hinged doors require a clearance for opening. This limitation can introduce complications in the design requirements. Hinged doors are pivotally cantilevered by hinges. This configuration induces an undesired load on the support column. Hinged doors can be dangerous in conditions, such as excessively rough seas, where the door can become unlatch.

Some vessel designs include a sliding door between the exterior deck of the vessel and the cabin interior. A sliding door is preferred over a hinged, swinging type of door because of space requirements and the negative aspects of a hinged door suddenly swinging in either direction due to rolling seas. Indeed, a swinging door could severely injure one person while he or she is trying to enter or exit through such door when the rolling of the vessel due to rough seas suddenly swings the door toward the person.

Known sliding doors are sliding doors in which at least a portion of the door is withdrawn into an enclosure. Such doors are well known in residential housing and offices, and have also been used in vessels where a swinging door is undesirable, and space is limited. Pocket doors are usually straight; however, it is known to use curved pocket doors in corner cabinets, furniture, and the like.

There are several conventional door systems, however, none of them allow the creation of a sliding access that can then be closed easily to restore the original height and shape of the gunwale of a marine vessel while providing easy entry to the deck of the vessel.

SUMMARY OF THE INVENTION

The present invention overcomes the deficiencies of the known art and the problems that remain unsolved by providing a method and respective apparatus for a marine vessel sliding door system and method of use, and more particularly, a marine vessel sliding door system useful for a vessel having a sliding door system that can be easily opened, and through which an easy access can be created to facilitate the accessibility of passengers onto/off of a vessel therefrom.

In accordance with one embodiment of the present invention, the invention consists of:

a hull comprising:

a displacement hull section extending downward from a waterline, a fixed gunwale formed about a portion of a peripheral edge of the hull, the fixed gunwale having a vertical dimension extending from a level above the waterline and terminating at a gunwale railing, the gunwale section having a horizontal dimension extending between a bow of the vessel and a fixed gunwale stern end, and a deck extending across at least a portion of an interior of the hull;

a sliding gunwale door assembly comprising:

a gunwale sliding door section bound by a sliding section leading edge, a sliding section railing, a sliding section stern edge, and a sliding section base, a first sliding member attached to the gunwale sliding door section, and a second sliding member attached to the deck, wherein the first sliding member slideably engages with the second sliding member;

the gunwale sliding door section being slideably positionable between:

a closed configuration wherein the sliding section leading edge abuts fixed gunwale stern end, and an open configuration wherein the gunwale sliding door section is positioned sternward creating an opening between the sliding section leading edge and the fixed gunwale stern end;

wherein the gunwale sliding door section is aesthetically continuous with the fixed gunwale having an exterior surface of the gunwale sliding door section being continuous with an adjacent exterior surface of the fixed gunwale and the sliding section railing being continuous with the gunwale railing.

In a second aspect, the lateral wall has a lid to substantially cover the head portion of door, wherein the junction of the head portion of the door and the lateral wall is not visible when the sliding door is in a closed position.

In another aspect, each gunwale sliding door section can be operated in any suitable manner, manually or otherwise, such as using a pneumatic ram.

In another aspect, at least one skirt is formed along a bottom portion of the sliding door and contiguous with an external surface of the gunwale sliding door section, wherein the skirt conceals the operational sliding interface.

In another aspect, a telescopic ladder is integrated into the hull.

In another aspect, a telescopic ladder is integrated into a cavity formed within the hull. The cavity can be concealed by and accessible through a ladder access deck hatch. The ladder access deck hatch can be removable, hinged, sliding, and the like, providing access to the telescoping ladder.

In another aspect, the side wall comprises lids, wherein the lids are mounted on an internal surface of the side wall, wherein the lids have a width covering the inside edge of the sliding door when the sliding door is in the closed position; and indentations corresponding to the lids.

Introducing a method embodiment, a method of providing a gunwale sliding door section to a pre-manufactured vessel comprising the step of obtaining the pre-manufactured vessel, wherein the pre-manufactured vessel comprises a concave shell defining a passenger-receiving section, the shell having a displacement hull section and a gunwale extending upwardly from a portion of waterline; cutting a portion of the side wall of the vessel; providing a sliding door; providing a sliding door system, this step of providing the sliding door system including installing a series of rail glide assemblies to the deck of the vessel, installing a set of rail assemblies to the gunwale sliding door section, and installing the sliding gunwale door assembly to the vessel.

In another aspect, the method further comprises a step of: installing a lid for sealing of the sliding door to the sidewall of the vessel.

In another aspect, the method further comprises a step of: installing the telescopic ladder under the deck;

In another aspect, wherein the step of cutting the side wall, the cutting comprises at least three cuts: the first cut is a vertical cut down to the deck of the vessel; the second cut is toward the end of the side wall including a portion of a transom; and the third cut is a vertical cut on the portion of the transom that is attached to the side wall.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
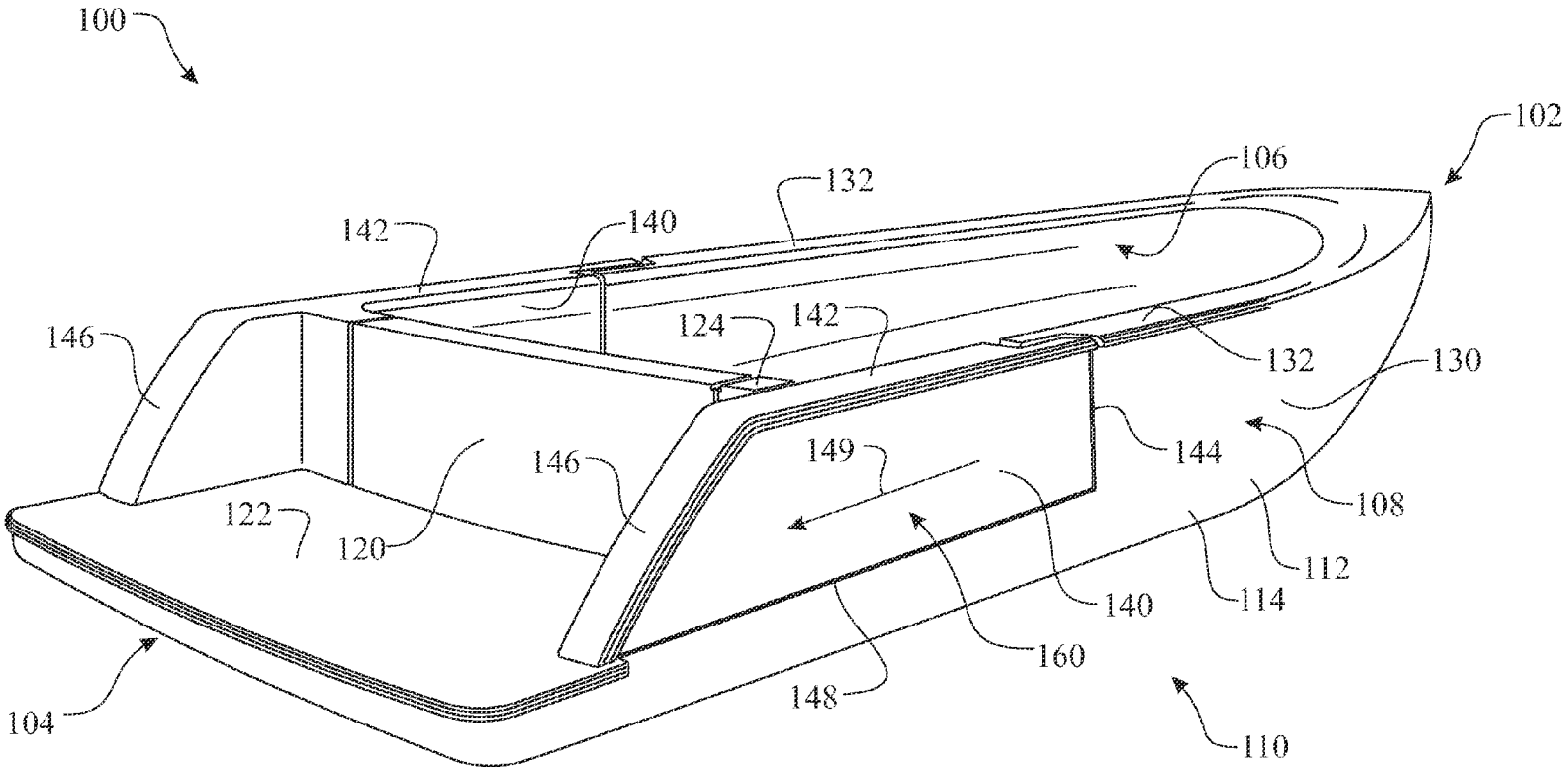
FIG. 1 presents a perspective view of an exemplary marine vessel comprising a first exemplary sliding gunwale segment, which provides an access or egress passageway through a gunwale of the vessel, wherein the sliding gunwale segment is illustrated in a closed configuration.
Figure 2:
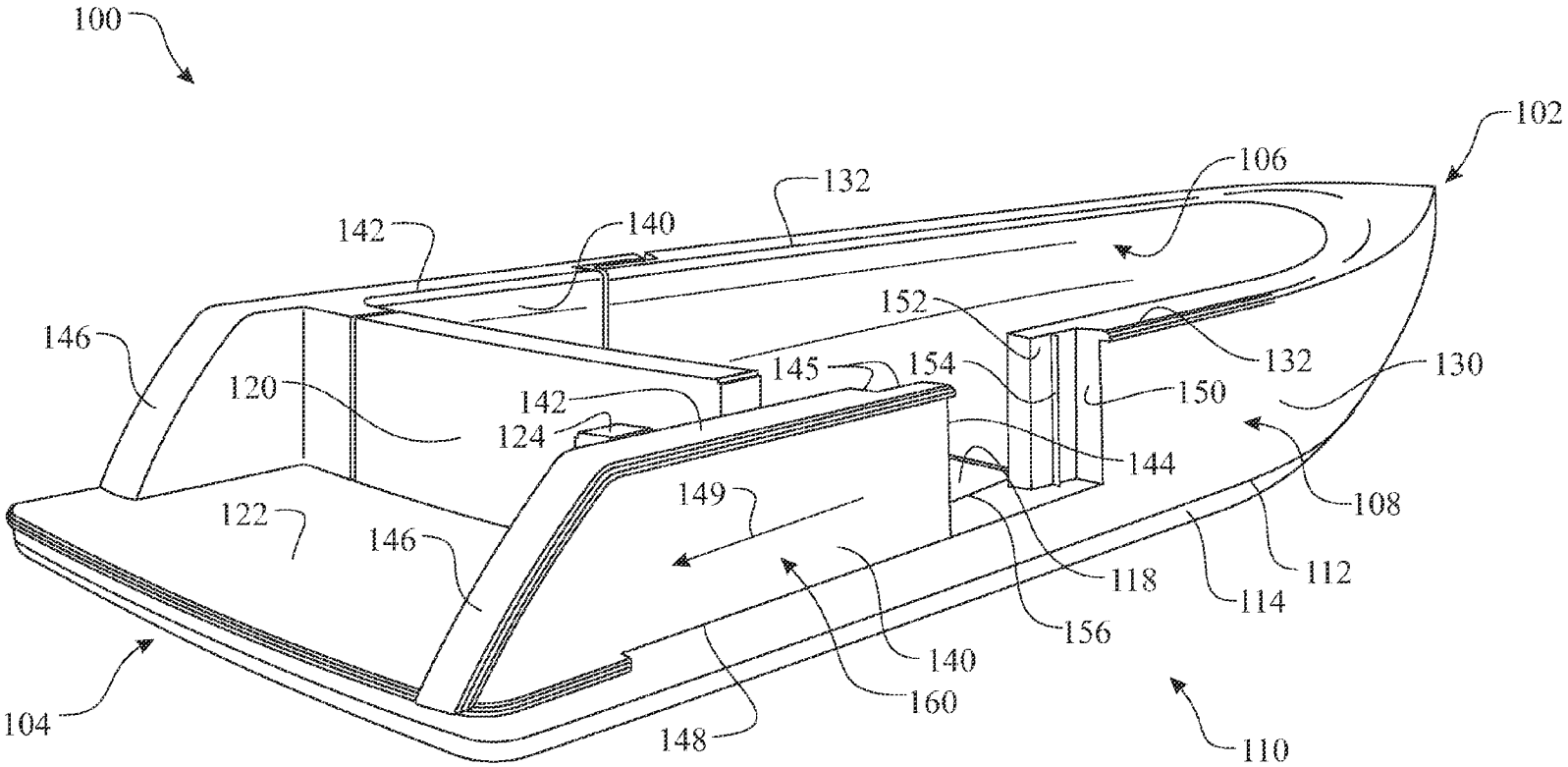
FIG. 2 presents a perspective view of the exemplary marine vessel introduced in FIG. 1, wherein the sliding gunwale segment is illustrated in an opened configuration.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. As used herein, the term "approximates" includes all situations where the approximating surfaces come to within 1 cm of one another, and specifically includes situations where the approximating surfaces touch one another. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary sliding gunwale door assembly 160 is presented in various configurations in the illustrated of FIGS. 1 through 6. The sliding gunwale door assembly 160 is integrated into a marine vessel 100 to facilitate boarding and disembarking of the marine vessel 100. For reference, the marine vessel 100 is manufactured having common marine vessel elements, including hull 110 comprising a displacement hull section 114 extending below a waterline 112 and a vessel sidewall or gunwale 130 extending upwards from the waterline 112. The displacement hull section 114 can be shaped in accordance with any known or unique naval architectural shape, including a flat bottom design, a "V" design, a deep "V" design, a catamaran or twin hull design, a tri-hull, and the like. A forward region of the marine vessel 100 is referred to as a bow 102. A rearward region of the marine vessel 100 is referred to as a stern 104. The surface of the hull 110 can be referenced as a hull exterior 108 and a hull interior 106. A transverse rear vertical section of the hull 110 is referred to as a transom 120. The gunwale 130 terminates along an upper edge referred to as a gunwale railing 132. The marine vessel 100 can include one or more decks 118. The decks 118 would be arranged in accordance with the design specifications of the marine vessel 100. The exemplary marine vessel 100 includes a single deck 118. A marine vessel 100 having multiple decks 118 might introduce a height limitation to the opening. An optional transom platform 122 can extend rearward from the transom 120. The marine vessel 100 can be fabricated of any suitable material or combination of materials, including fiberglass, wood, metal, and the like.

The sliding gunwale door assembly 160 provides several advantages over currently available passageways. A first advantage is the minimal impact on the deck design of the marine vessel 100. A second advantage is the ability to increase a designed width of the opening or passageway. A third advantage of the sliding gunwale door assembly 160 is a safety consideration, wherein the sliding gunwale door assembly 160 will remain in position when the marine vessel 100 is underway in rough seas.

The sliding gunwale door assembly 160 is integrated into rearward portion of the gunwale 130, while maintaining a visually aesthetic continuity therewith. The fixed section of the gunwale 130 terminates at a fixed gunwale stern end 150, wherein the fixed gunwale stern end 150 is forward of the transom 120. The sliding gunwale door assembly 160 slideably assembles a gunwale sliding door section 140 to the deck 118 of the marine vessel 100 using a rail assembly 180 slideably assembled to a rail glide assembly 190. The gunwale sliding door section 140 is designed to be a continuous section of the gunwale 130, wherein the gunwale sliding door section 140 initiates at the fixed gunwale stern end 150. The gunwale sliding door section 140 includes a sliding section leading edge 144, which matingly engages with the fixed gunwale stern end 150, a sliding section railing 142, which aesthetically continues the gunwale railing 132 sternward, a sliding section stern edge 146, which provides a, aesthetically pleasing terminal end of the gunwale 130 and a sliding section base 148, which is generally parallel with the deck 118.

The sliding gunwale door assembly 160 extends rearward from the fixed gunwale stern end 150. The gunwale sliding door section 140 is slideably assembled to a deck 118 using a series of rail assemblies 180 slideably assembled to a plurality of rail glide assemblies 190. The employment of multiple rail assemblies 180 and a respective pairing of rail glide assemblies 190 stabilizes the gunwale sliding door section 140 against any unwarranted lateral, vertical, or rotational motion. A single rail assembly 180 and respective number of rail glide assemblies 190, would retain the gunwale sliding door section 140 to a longitudinal motion, but fails to restrict a rotational motion. The inclusion of a second rail assembly 180 parallel to a first rail assembly 180 additional restricts the rotational motion about the longitudinal axis of the rail assembly 180. Although the exemplary embodiment utilizes multiple rail glide assemblies 190 arranged in a spatial manner, it is understood that the rail glide assembly 190 can be a single elongated member, wherein the rail glide assembly 190 would be of a desired continuous length.

Figure 3:
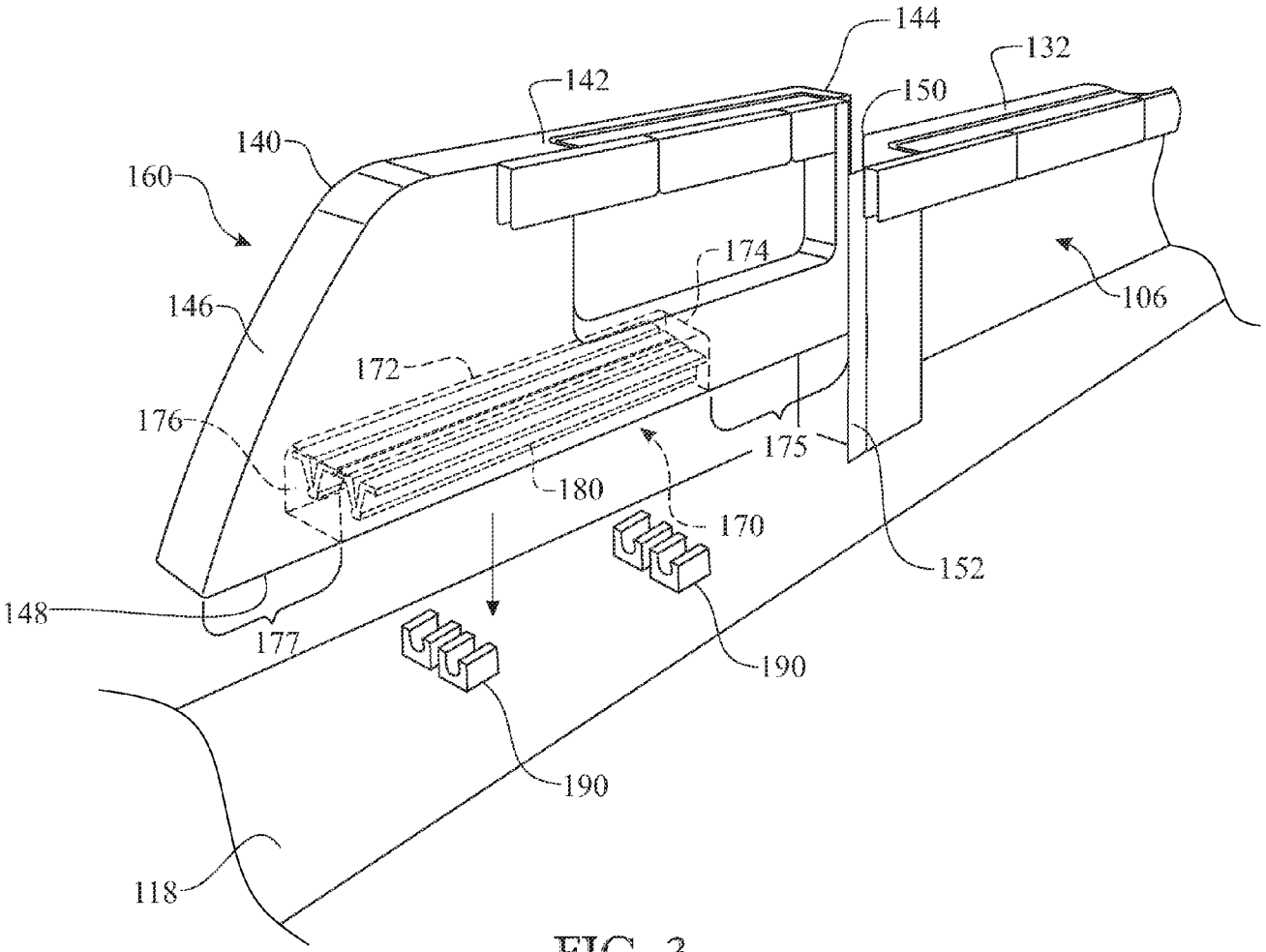
FIG. 3 presents a perspective partially exploded assembly view illustrating an assembly of rails of the sliding gunwale segment to slides assembled to a deck of the marine vessel.

Longitudinal motion of the gunwale sliding door section 140 is governed by the design of the sliding gunwale door assembly 160. The rail assemblies 180 are installed into a sliding member rail cavity 172 of a sliding member rail receptacle 170 within a lower region of the gunwale sliding door section 140 as best illustrated in FIG. 3. The sliding member rail cavity 172 extends inward from the sliding section base 148 of the gunwale sliding door section 140 and along a predetermined longitudinal length spanning between a rail cavity forward end 174 and a rail cavity rearward end 176. The rail cavity forward end 174 is located at a distance of a forward unbridled section 175 from the sliding section leading edge 144 of the gunwale sliding door section 140. The rail cavity rearward end 176 is located at a distance of a rearward unbridled section 177 from the lower corner of the sliding section stern edge 146 of the gunwale sliding door section 140. The rail assembly 180 is slideably assembled to the respective rail glide assemblies 190. The rail glide assemblies 190 are arranged in a spatial linear manner. It is understood that the motion limiting features can be any known motion-limiting feature known by those skilled in the art. In the exemplary embodiment, the rearward sliding motion 149 of the gunwale sliding door section 140 is governed by the location of the forward most rail glide assemblies 190 and the rail cavity forward end 174. In the exemplary embodiment, the forward sliding motion of the gunwale sliding door section 140 is governed by the location of the rearward most rail glide assemblies 190 and the rail cavity rearward end 176 and/or the engagement of the sliding section leading edge 144 and the fixed gunwale stern end 150. Alternatively, stops can be integrated into the rail assembly 180, wherein the stops would engage with the respective rail glide assembly 190 to limit the forward and/or rearward sliding motion 149.

Figure 4:
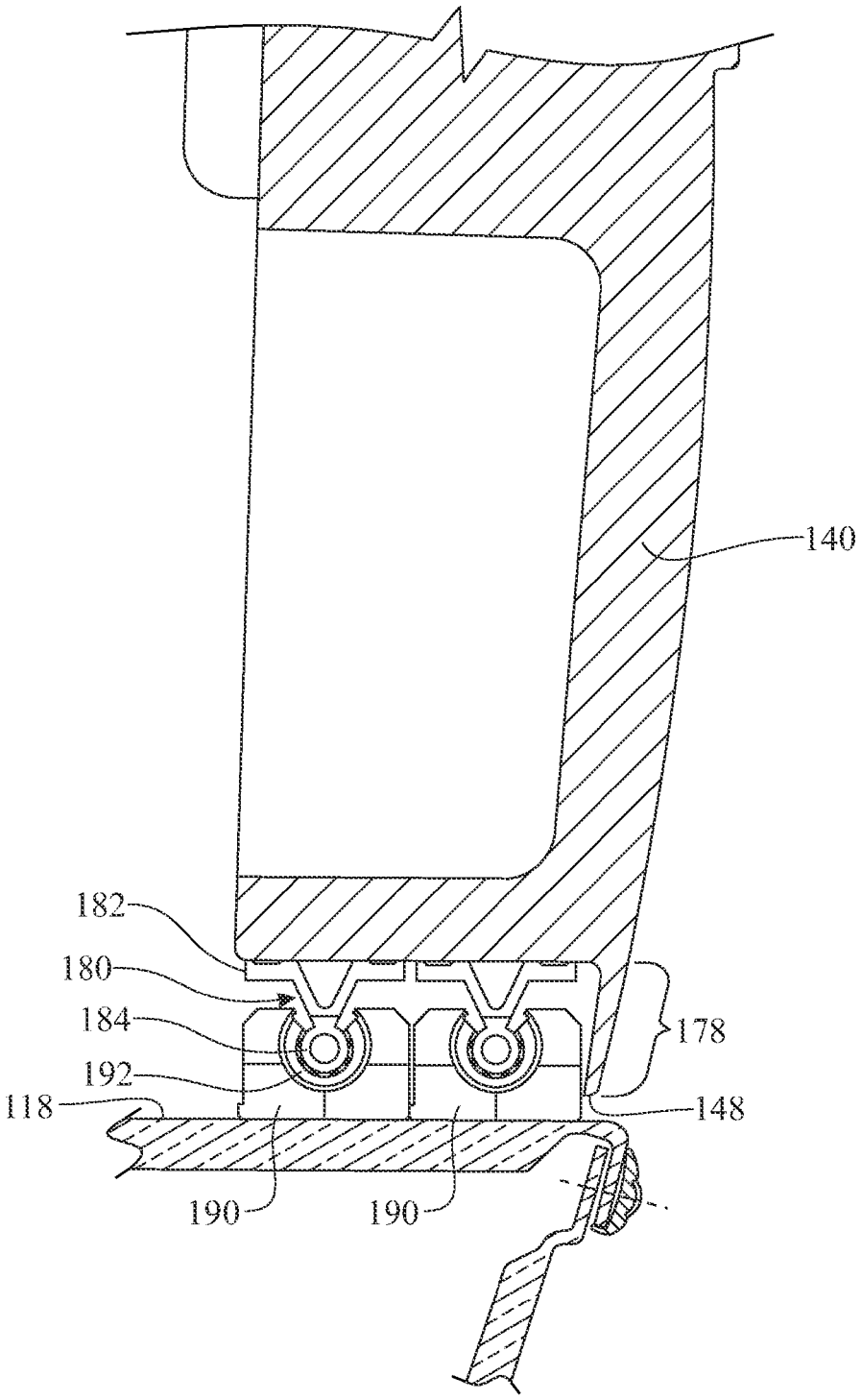
FIG. 4 presents a cross-sectional view of the sliding gunwale segment illustrating the rail and slide member interface.
Figure 5:
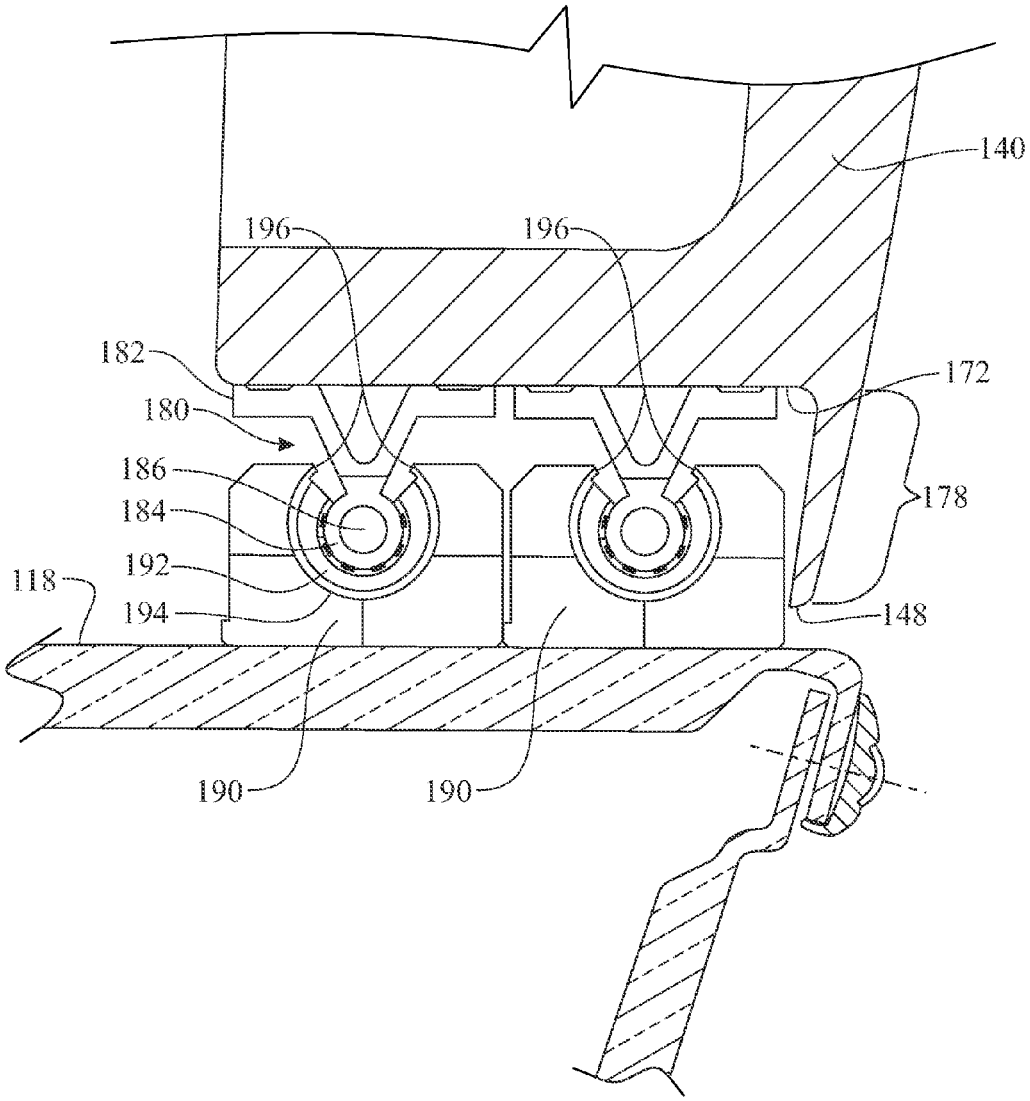
FIG. 5 presents an magnified cross-sectional view detailing the rail and slide member interface.
Figure 6:
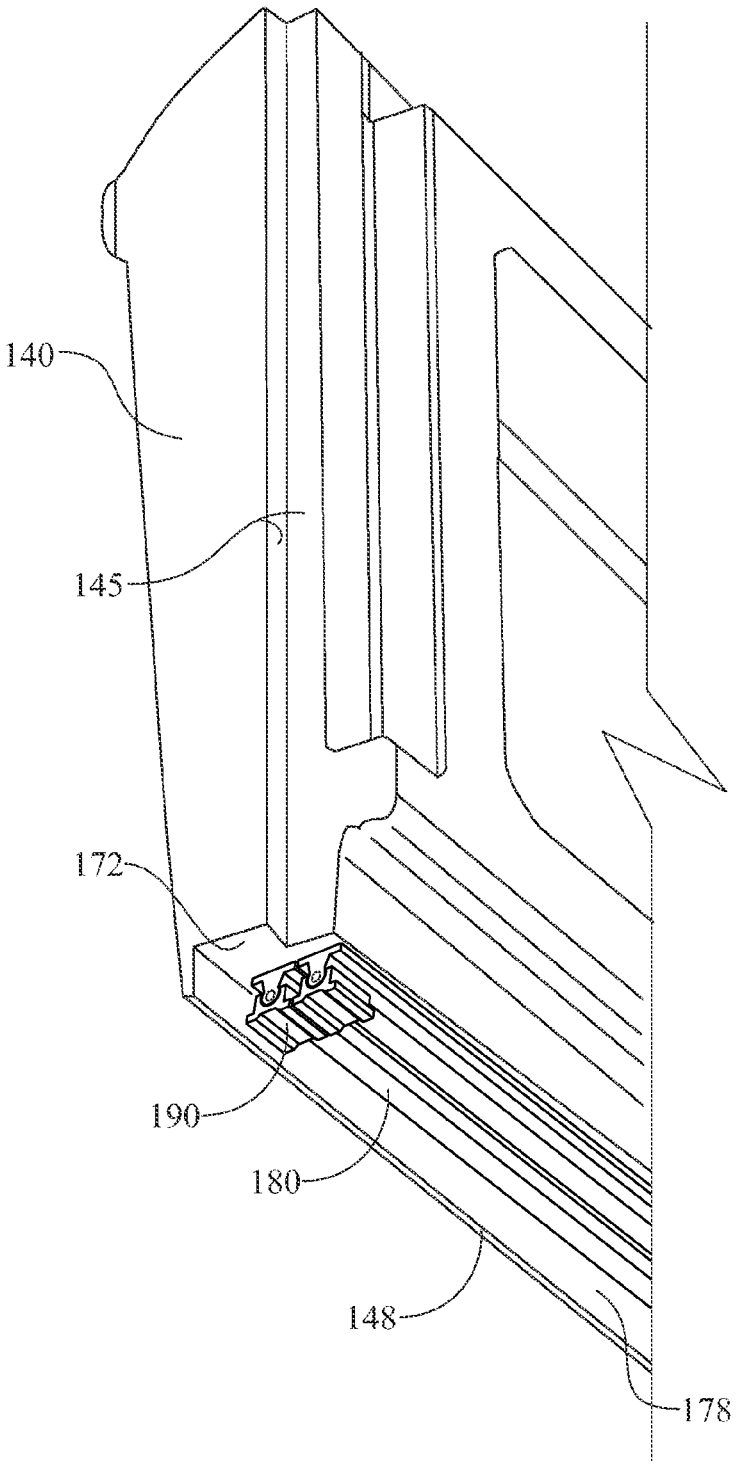
FIG. 6 presents a perspective bottom view detailing the interface between the rail assembly and the rail glide assemblies.

The exemplary sliding gunwale door assembly 160 utilizes a rail assembly 180 slideably assembled to a plurality of spatially arranged rail glide assembly 190, as best shown in the illustrations presented in FIGS. 4 and 5. The rail assembly 180 includes a rail slide section 184 carried by an apex of a rail beam section 182. The rail slide section 184 can be solid or hollow, incorporating a rail slide section hollowed center 186. The rail beam section 182 can be shaped in any supporting formation, including an "I" beam, a "T" beam, a "V" shape, a "U" shape, and any other suitable supporting member shape. The rail slide section 184 has a cross sectional shape that is compatible with a rail glide bushing 192. The rail glide bushing 192 is provided as either an insert or integrally formed within the rail glide assembly 190. In an insert configuration, the rail glide bushing 192 is inserted into a rail glide cavity 194 formed within the rail glide assembly 190. The rail glide bushing 192 can utilize any friction reducing elements, including grease, bearings, and the like. Although, in the exemplary embodiment, the rail slide section 184 has a circular cross sectional shape, it is understood that the rail slide section 184 can be formed having any cross sectional shape. A glide rail clearance 196 is formed along a portion of the rail glide assembly 190 providing a passageway for the rail beam section 182. The rail glide bushing 192 is preferably shaped to circumscribe greater than 180 degrees of the circumference of the rail slide section 184, thus introducing and providing a vertical element of support for the rail assembly 180.

It is desired that marine vessels 100 be designed to minimize flow of water from the body of water into the interior of the marine vessel 100. This is accomplished by a combination of the shape of the displacement hull section 114 and the shape and height of the gunwale 130. The integration of the gunwale sliding door section 140 along a rear section of the gunwale 130 introduces two points of potential breach for water flow into the hull interior 106. Seals, such as a gunwale sealing element 154 and a deck sealing element 156 can be employed to minimize flow of water from the body of water into the interior of the marine vessel 100.

The inclusion of a sliding section cavity exterior skirt 178 on an exterior side of the sliding member rail cavity 172 provides additionally sealing benefits. The sliding section cavity exterior skirt 178 additionally provides protection to the sliding gunwale door assembly 160 from both mechanically induced damage as well as degradation from the elements. The sliding section cavity exterior skirt 178 would reduce water intrusion into the sliding gunwale door assembly 160. It is understood that one or more seals can be employed between the sliding section cavity exterior skirt 178 (and/or the sliding section base 148) and rail glide assembly 190 and/or the deck 118 to improve the barrier against water intrusion. The sliding section cavity exterior skirt 178 would reduce exposure of the sliding gunwale door assembly 160 to contaminants, such as dirt, debris, and the like. The sliding section cavity exterior skirt 178 would additionally act as a barrier from potential damage from impact of objects as they pass by the gunwale sliding door section 140.

The fixed gunwale stern end 150 can be shaped to include a sliding member support column 152. Similarly, the sliding section leading edge 144 can be shaped to include a mating leading edge rabbet 145, wherein the leading edge rabbet 145 would overlap and engage with the sliding member support column 152 providing additional sealing and/or structural support. The overlapping design provides structural support for the gunwale sliding door section 140 when the marine vessel 100 is subjected to severe wave conditions that could apply excessive pressure against an exterior surface of the gunwale sliding door section 140. It is also noted that the transom 120 provides additional structural support. The gunwale sliding door section 140 can be designed to engage with an outer edge of the transom 120. In the exemplary embodiment, the gunwale sliding door section 140 includes a small projecting transom engaging column 124 that aligns with the transom 120 when moved into a closed configuration. This design feature reduces any interaction between an interior surface of the gunwale sliding door section 140 and the outer end of the transom 120, thus eliminating friction, damage, and the like during motion of the gunwale sliding door section 140.

The rail assembly 180 and rail glide assembly 190 are preferably fabricated using an extruding process. This ensures a parallel cross sectional shape along an entire length of each component. The materials would be slideably compatible and selected of materials suited for a harsh marine environment.

In use, the gunwale sliding door section 140 would be slide rearward in accordance with a sliding section motion 149 to create a passageway for embarking or debarking the marine vessel 100. The sliding section motion 149 can be manually driven or automated. An automated system can utilize an electrically operated motion driving system, a pneumatically operated motion driving system, a hydraulically operated motion driving system, and the like. The sliding gunwale door assembly 160 can include one or more latches to retain the gunwale sliding door section 140 in a desired (either open or closed) configuration. The latches can be operated by a handle or any other element provided by the designer.

Since the gunwale sliding door section 140 defines a rearmost portion of the gunwale 130, the designer is less constrained when determining the width of the passageway created when the gunwale sliding door section 140 is moved rearward. This enables a wider passageway compared to a hinged door or gate configuration. Additionally, the sliding design introduces a number of safety features over the inherent safety issues associated with the hinged configuration. A sliding pocket configuration introduces potential for servicing issues, damage during use, and other deterrents that are not conducive to a marine environment. The integration of the gunwale sliding door section 140 at the rearward portion of the gunwale 130 introduces other advantages over a mid-integration design. The mid-ship integration design dictates features that break the continuity of design between the gunwale sliding door section 140 and the gunwale 130. The mid-ship integration dictates that any sliding door configuration would be either an offset design or a pocket design. In either configuration, the design would dictate discontinuity between the gunwale sliding door section 140 and the gunwale 130.

Figure 7:
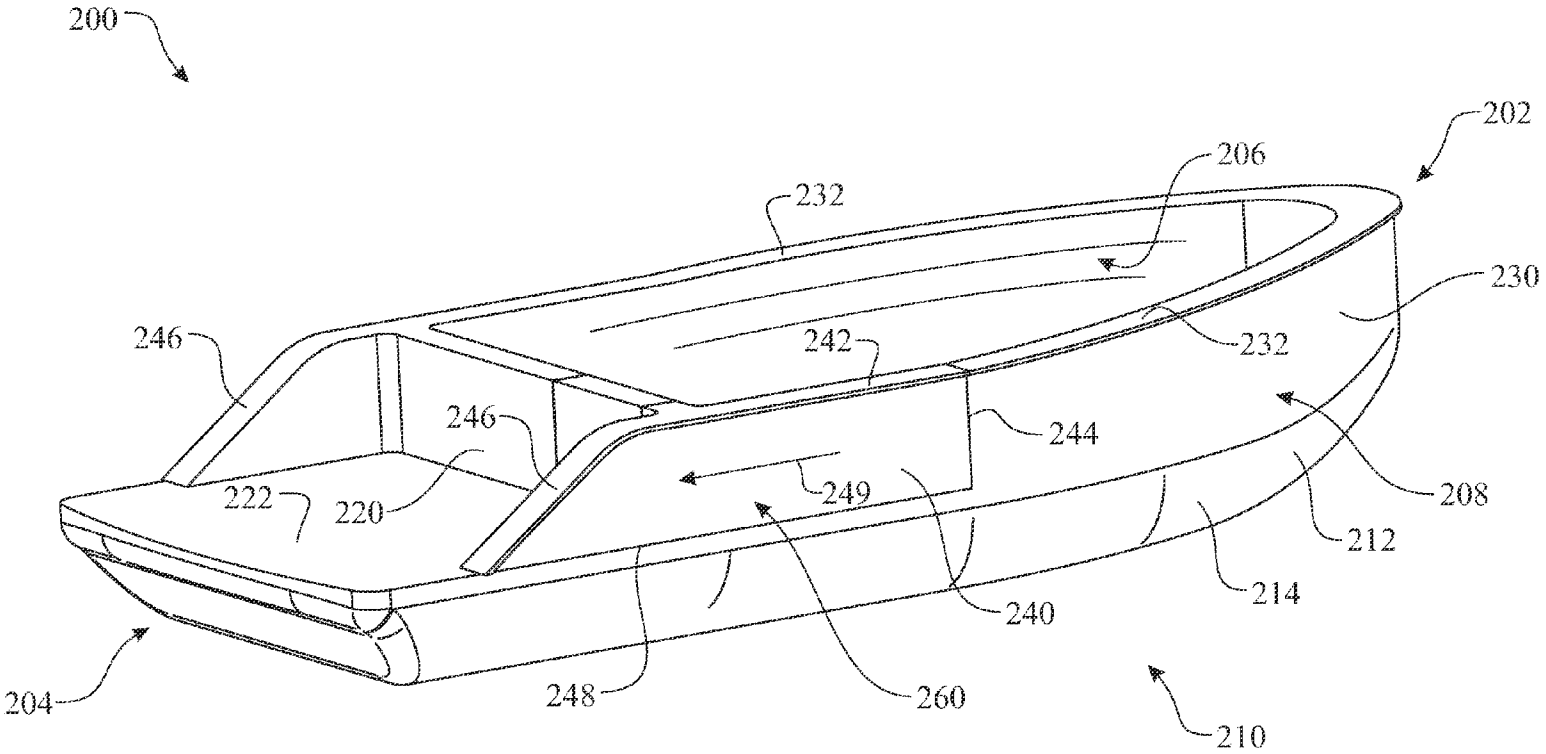
FIG. 7 presents a perspective view of an exemplary marine vessel comprising a second exemplary sliding gunwale segment, which provides an access or egress passageway through a gunwale of the vessel, wherein the sliding gunwale segment is illustrated in a closed configuration.
Figure 8:
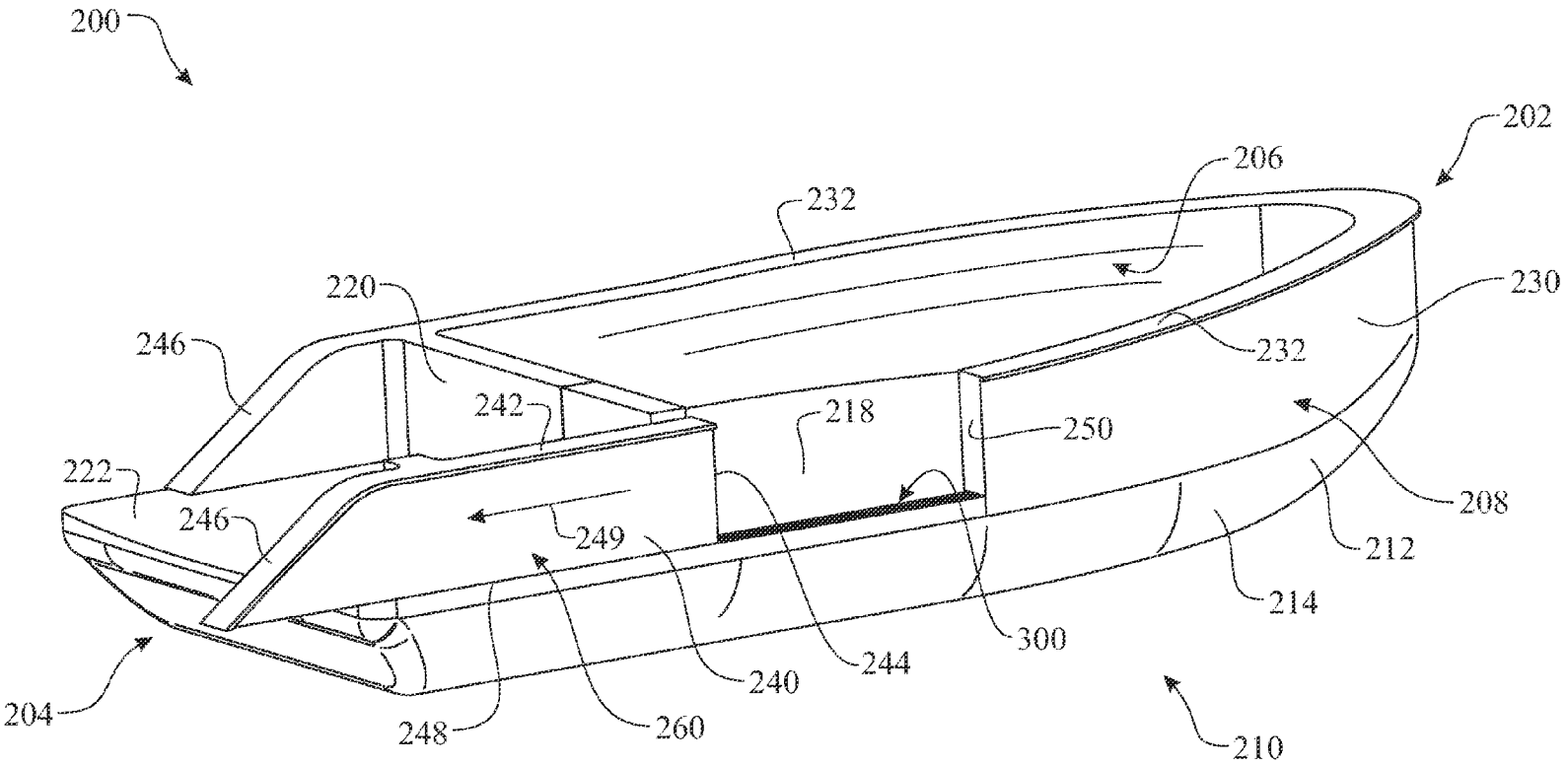
FIG. 8 presents a perspective view of the exemplary marine vessel introduced in FIG. 7, wherein the sliding gunwale segment is illustrated in an opened configuration.
Figure 9:
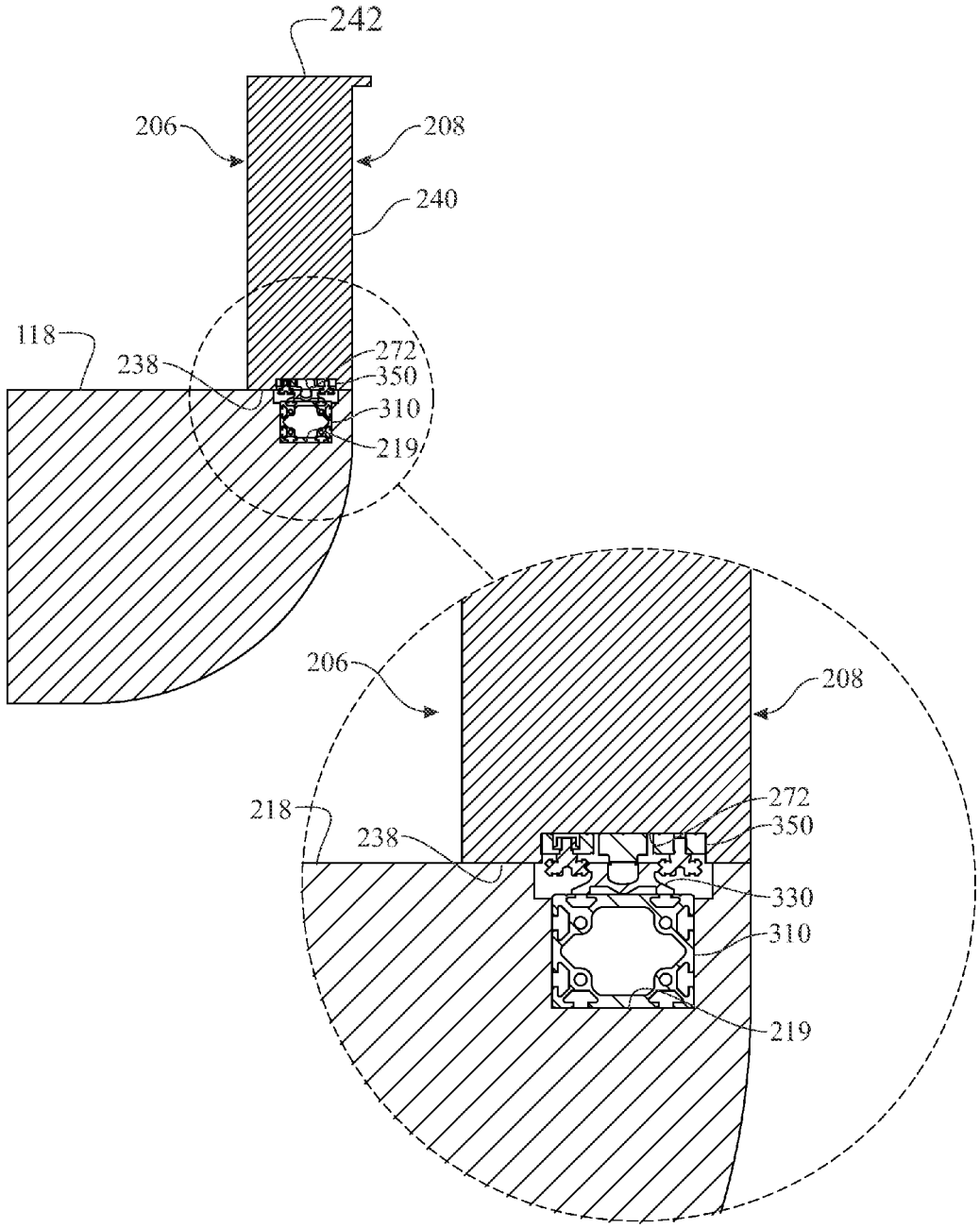
FIG. 9 presents a cross-sectional view of the sliding gunwale segment detailing a second exemplary rail and slide member interface.
Figure 10:
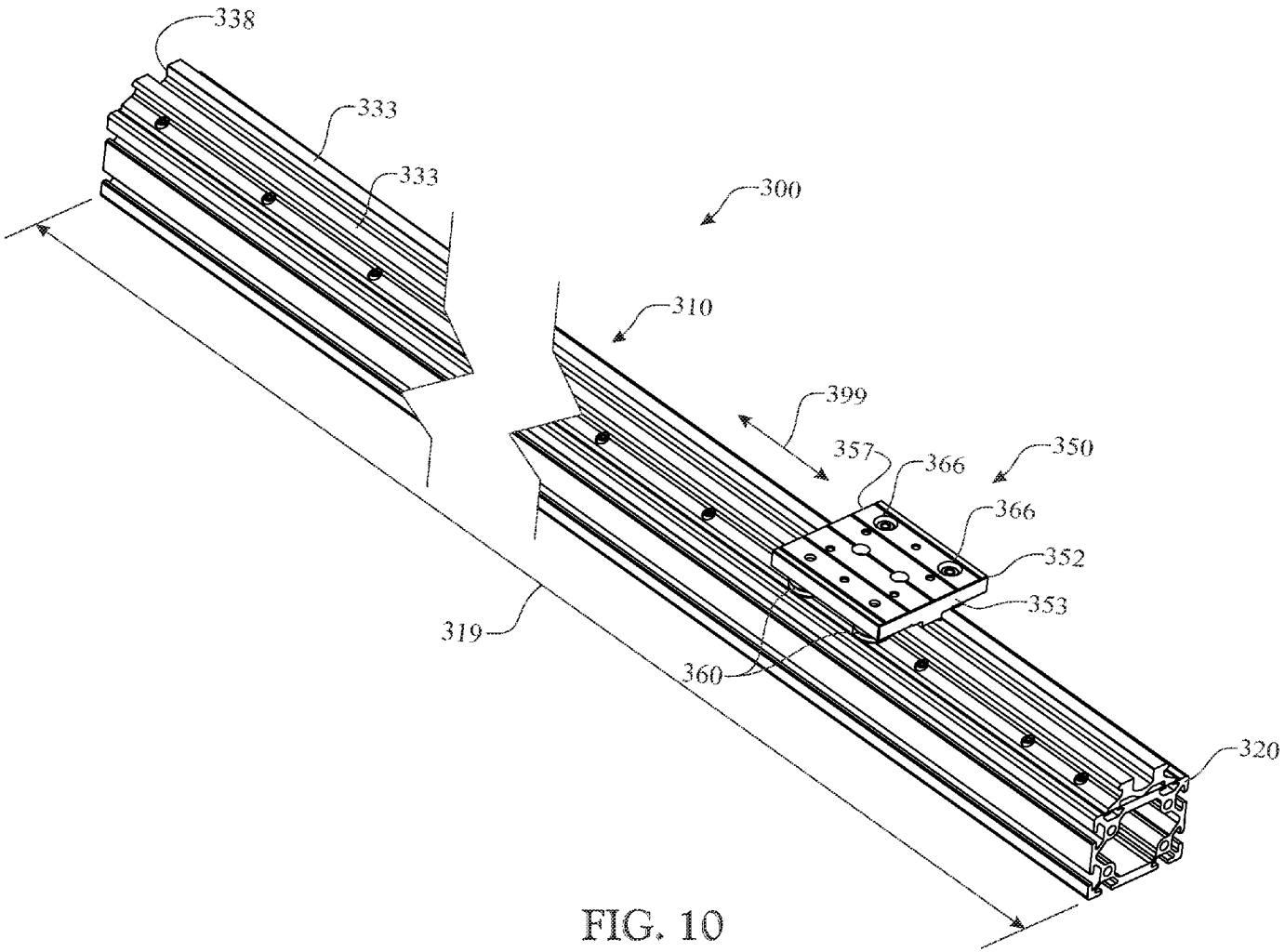
FIG. 10 presents an isometric view of the second exemplary rail and slide member interface.
Figure 11:
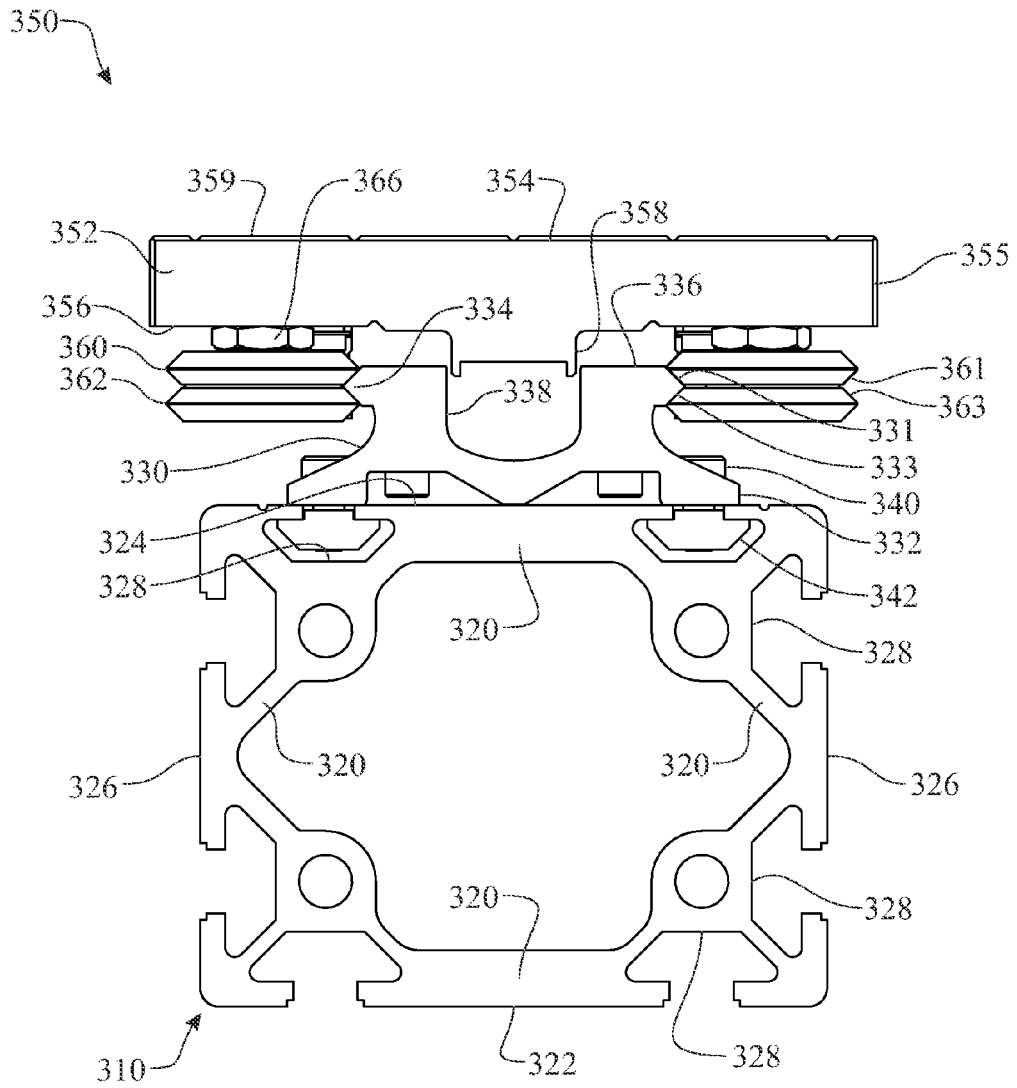
FIG. 11 presents a cross-sectional view of the second exemplary rail and slide member interface.

A second exemplary embodiment of a gunwale sliding section 240 integrated into a marine vessel 200 is presented in the illustrations of FIGS. 7 through 9 with details of the sliding assembly being detailed in the illustrations presented in FIGS. 10 and 11. The majority of the features of the marine vessel 100 and marine vessel 200 are the same, with the differences being described herein. Like elements of the marine vessel 200 and marine vessel 100 are numbered the same, except preceded by the numeral "2".

In the second exemplary embodiment, the gunwale 230 terminates at a fixed gunwale stern end 250, wherein the fixed gunwale stern end 250 is generally perpendicular to the sidewall of the gunwale 230. The gunwale sliding section 240 is formed having a sliding section leading edge 244, wherein the sliding section leading edge 244 is generally perpendicular to the sidewall of the gunwale sliding section 240. The sliding section leading edge 244 abuts the fixed gunwale stern end 250 when the gunwale sliding section 240 is in a closed configuration.

The sliding member assembly 260 differs from the sliding gunwale door assembly 160. Details of the sliding member assembly 260 are illustrated in FIGS. 9 through 11. The sliding member assembly 260 comprises a series of components forming an elongated linear motion support assembly. The sliding member assembly 260 includes a sliding system glide rail 330 assembled to a sliding system base rail 310. A sliding support assembly 350 is slideably assembled to the sliding system guide rail 330 by a plurality of sliding support assembly proximal wheel 360, 362.

The sliding system base rail 310 is fabricated of a base rail body 320 having a rail body base surface 322 and a rail body glide rail assembly surface 324, wherein the rail body base surface 322 and the rail body glide rail assembly surface 324 are preferably parallel to one another and located on opposite sides of the base rail body 320. A rail body side surface 326 extends between the rail body base surface 322 and rail body glide rail assembly surface 324 forming sides of the base rail body 320. A mounting feature is incorporated into the base rail body 320, wherein one mounting feature is utilized for attachment of the sliding system base rail 310 to the deck 218 and a second mounting feature is utilized for attachment of the sliding system glide rail 330. The exemplary embodiment includes a pair of base rail attachment groove 328 formed in the rail body base surface 322 for attachment of the sliding system base rail 310 to the deck 218 and a pair of base rail attachment groove 328 formed in the rail body glide rail assembly surface 324 for attachment of the sliding system glide rail 330. The sliding system base rail 310 is preferably fabricated using an extruding process. This ensures a parallel cross sectional shape along an entire length of the sliding system base rail 310. The sliding system base rail 310 would be manufactured of a material that is preferably capable of being shaped through an extruding process and would be suited for a harsh marine environment, such as aluminum, stainless steel, plastic, and the like. The exposed surfaces of the sliding system base rail 310 can be treated to minimize any potential for corrosion, such as anodizing, plating, painting, epoxy coating, and the like. The cross-sectional shape of the sliding system base rail 310 can include features to aid in the attachment of the sliding system base rail 310 to other components, increase rigidity of the sliding system base rail 310, and the like.

The sliding system glide rail 330 is designed incorporating at least one glide rail mounting foot 332 and at least one wheel track 334. A series of attachment features, such as bores, slots, and the like formed through the at least one glide rail mounting foot 332, to receive a sufficient number of male rail fasteners 340 provided along a mounting edge for attachment of the sliding system glide rail 330 to the sliding system base rail 310. The preferred embodiment includes a pair of parallel spatially arranged rails forming a pair of glide rail mounting feet 332 extending a length 319 of the sliding system glide rail 330. Each wheel track 334 is designed incorporating a wheel-supporting surface. The wheel-supporting surface is preferably shaped to enable longitudinal motion, while restraining against any lateral or vertical motion. The exemplary embodiment comprises a pair of opposite wheel track 334, each wheel track 334 having a first angled surface 331 and a second angled surface 333 forming an outward extending horizontal "V" shapes wheel-supporting surface.

A longitudinal retention groove 338 is preferably formed extending longitudinally along a length of an upper centered portion of a glide rail upper surface 336 of the sliding system glide rail 330. The longitudinal retention groove 338 includes a recessed span formed across an upper edge thereof. The sliding system glide rail 330 is preferably fabricated using an extruding process and an optional secondary machining process. The optional secondary machining process would be used to create the attachment features, such as bores, slots, and the like, for receiving each male rail fastener 340. The sliding system glide rail 330 would also be manufactured of a material that is preferably capable of being shaped through an extruding process and would be suited for a harsh marine environment, such as aluminum, stainless steel, plastic, and the like. The exposed surfaces of the sliding system glide rail 330 can be treated to minimize any potential for corrosion, such as anodizing, plating, painting, epoxy coating, and the like.

The sliding support assembly 350 is fabricated having a sliding support body 352, wherein the sliding support body 352 is shaped having an upper surface 354 that can be covered with a resilient dampening material 359, a pair of side surfaces 355, a front surface 353, a rear surface 357, and a lower surface 356. A sliding support central guide 358 extends downward from a central section of the sliding support body 352. The sliding support central guide 358 is designed having a horizontal width that is substantially equal to the upper opening span of the longitudinal retention groove 338. Additionally, the sliding support central guide 358 extends downward to a distance wherein the distal end of the sliding support central guide 358 encroaches into the longitudinal retention groove 338. In the exemplary embodiment, each pair of two pair of support wheels 360, 362 are rotationally assembled to the sliding support body 352 by a respective wheel mounting axle 366. The support wheels 360, 362 are assembled to the sliding support assembly 350 in an arrangement straddling and engaging each the respective wheel track 334. A proximal wheel contact surface 361 of the sliding support assembly proximal wheel 360 engages with the first angled surface 331 and a distal wheel contact surface 363 of the sliding support assembly distal wheel 362 engages with the second angled surface 333.

It is understood that the support wheels 360, 362 can be combined into a single wheel and include a shape that is congruent with the shape of the respective wheel track 334. In the exemplary embodiment, the wheels form a radially inward "V" which rides along the outward extending horizontal "V" shaped wheel track 334. It is understood that a circumferential shape of the wheel or wheels 360, 362 and the mating elongated cross sectional shape of the wheel track 334 have similar mating shapes, wherein the shape governs horizontal and vertical motion, while enabling longitudinal motion of the wheels 360, 362 along a length of the wheel track 334. Other exemplary wheel track 334 shapes include a "C" shape, a tongue and groove, a notch, and the like.

The sliding system glide rail 330 is assembled to the sliding system base rail 310 by inserting the male rail fastener 340 though the bores formed in the glide rail mounting foot 332 and threadably securing the male rail fastener 340 to a female rail fastener 342. The female rail fastener 342 is slideably inserted into the respective base rail attachment groove 328. Once all of the male rail fasteners 340 are threadably inserted into each respective female rail fastener 342, the sliding system glide rail 330 is located at a desired positioned along the sliding system base rail 310. Once in position, each of the male rail fasteners 340 is tightened, affixing the sliding system glide rail 330 in position.

The sliding support assembly 350 is placed above the sliding system glide rail 330. The optional sliding support central guide 358 is inserted into the longitudinal retention groove 338. The sliding support central guide 358 provides registration and lateral stability between the sliding support assembly 350 and the sliding system glide rail 330. The support wheels 360, 362 are rotationally assembled to the sliding support assembly 350 by a sliding support assembly distal wheel 362. The edges 361, 363 of the support wheels 360, 362 are positioned against the angled surfaces 331, 333 of the wheel track 334 during the wheel assembly process. By utilizing a two pair of wheels 360, 362 engaging with respective wheel track 334, wherein the wheel track 334 are located on opposite sides of the sliding system glide rail 330, the design restrains lateral movement of the sliding support assembly 350.

When assembled, the sliding support assembly 350 rolls along a length 319 of the sliding system base rail 310 in accordance with a longitudinal motion 399. The wheel and track interface shape restrains the sliding support assembly 350 to a longitudinal motion; restricting the sliding support assembly 350 from any lateral or vertical motion. The longitudinal motion 399 of the sliding support assembly 350 along the length 319 of the sliding system glide rail 330 is governed by any suitable motion-limiting feature.

Figure 12:
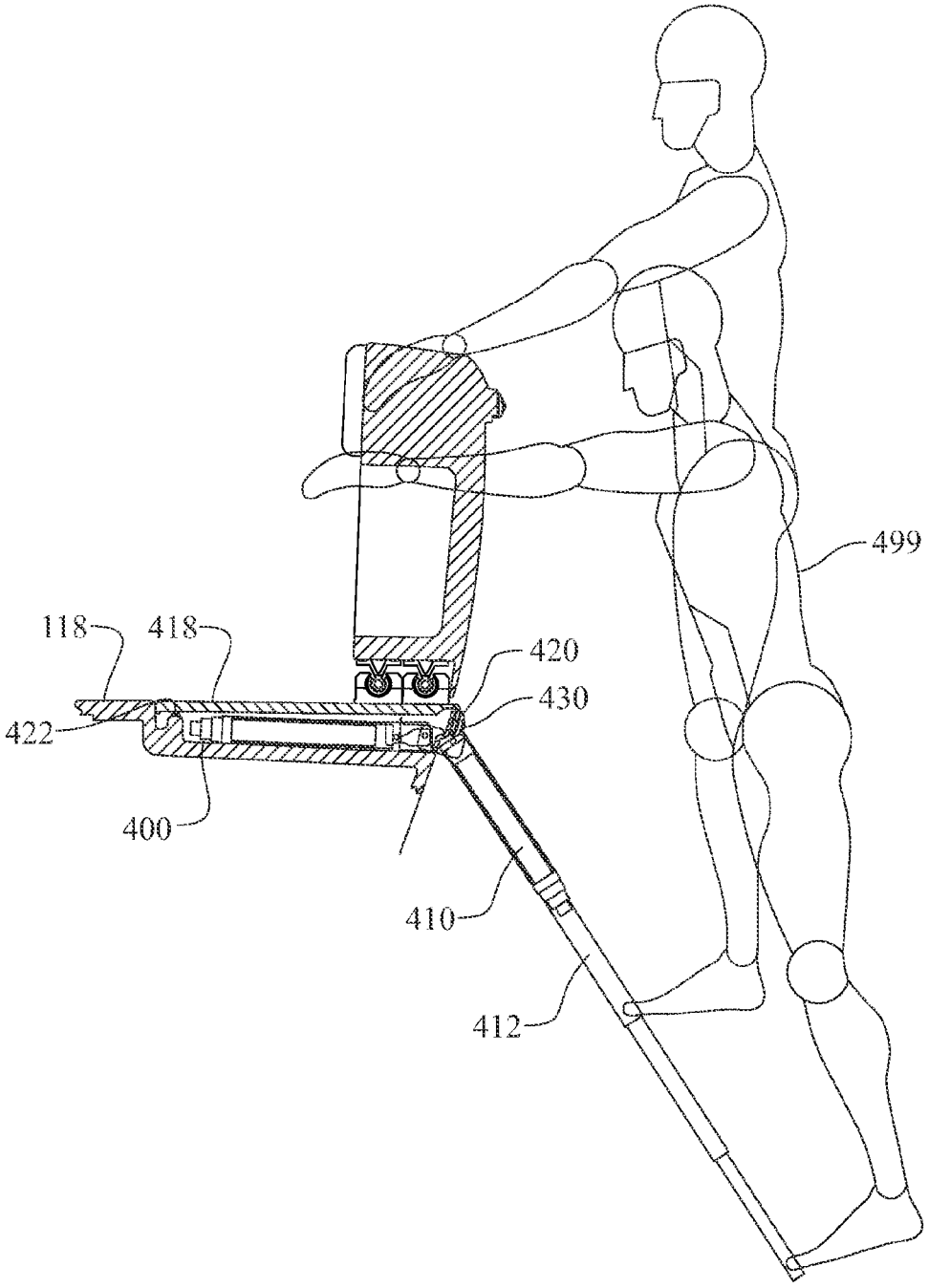
FIG. 12 presents a partially sectioned elevation view of an exemplary telescoping ladder.

A ladder may be desirous in conditions where the deck 118 is above a loading platform or where an individual 499 is coming on deck 118 from a body of water. A telescoping ladder 410 may be stowed in a ladder storage cavity 400, as illustrated in FIG. 12, for use in conditions where the deck 118 is above a loading platform or where an individual 499 is coming on deck 118 from a body of water. The telescoping ladder 410 can be deployed by extracting the telescoping ladder 410 from the ladder storage cavity 400, then telescoping the telescoping legs 412. The telescoping ladder 410 can rotate from a generally horizontal orientation to an angled loading configuration by a telescoping ladder pivot 430. The ladder storage cavity 400 is concealed and accessible by a ladder access deck hatch 418. The ladder access deck hatch 418 is pivotally assembled to the hull 110 by an access hatch hinge 420. A free end of the ladder access deck hatch 418 is supported by a hatch support 422. The hatch support 422 retains an exposed upper surface of the ladder access deck hatch 418 level with the deck 118. The telescoping ladder 410 would be located on the hull 110 where the telescoping ladder 410 is aligned with an opening created by the gunwale sliding door section 140.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A marine vessel comprising a gunwale door system, the vessel comprising:

a hull comprising:

a displacement hull section extending downward from a waterline, a fixed gunwale formed about a portion of a peripheral edge of said hull, said fixed gunwale having a vertical dimension extending from a level above said waterline and terminating at a gunwale railing, said gunwale section having a horizontal dimension extending between a bow of said vessel and a fixed gunwale stern end, and a deck extending across at least a portion of an interior of said hull;

a sliding gunwale door assembly comprising:

a gunwale sliding door section bound by a sliding section leading edge, a sliding section railing, a sliding section stern edge, and a sliding section base, a first sliding member attached to said gunwale sliding door section, and a second sliding member attached to said deck, wherein said first sliding member slideably engages with said second sliding member;

said gunwale sliding door section being slideably positionable between:

a closed configuration wherein said sliding section leading edge abuts fixed gunwale stern end, and an open configuration wherein said gunwale sliding door section is positioned sternward creating an opening between said sliding section leading edge and said fixed gunwale stern end;

wherein said gunwale sliding door section has an exterior surface that is continuous with an adjacent exterior surface of said fixed gunwale and wherein said sliding section railing is continuous with said gunwale railing; further wherein said gunwale sliding door section further comprises a projecting transom engaging column, wherein projecting transom engaging column aligns and engages with a transom of said vessel when said gunwale sliding door section is positioned into a closed configuration.

2. A marine vessel comprising a gunwale door system as recited in claim 1, said gunwale sliding door section further comprising a sliding member rail cavity, wherein said first sliding member is assembled to said gunwale sliding door section within said sliding member rail cavity.

3. A marine vessel comprising a gunwale door system as recited in claim 1, further comprising a sealing element providing a water barrier between said sliding section leading edge and said fixed gunwale stern end.

4. A marine vessel comprising a gunwale door system as recited in claim 1, further comprising a sliding member support column extending sternward of said fixed gunwale stern end; and a leading edge rabbet formed in said sliding section leading edge, wherein said leading edge rabbet engage with said sliding member support column when said gunwale sliding door section is positioned into a closed configuration.

5. A marine vessel comprising a gunwale door system as recited in claim 1, said gunwale sliding door section further comprising a skirt on an exterior surface thereof, wherein said skirt conceals said first sliding member.

6. A marine vessel comprising a gunwale door system as recited in claim 1, further comprising a telescopic ladder under said deck.

7. A marine vessel comprising a gunwale door system, the vessel comprising:

a hull comprising:

a displacement hull section extending downward from a waterline, a transom comprising an elongated, generally vertical wall defining a plane that is generally perpendicular to a centerline of said displacement hull section having a substantially vertical and transverse orientation, said transom being located proximate to a stern of said displacement hull section, a fixed gunwale formed about a portion of a peripheral edge of said hull, said fixed gunwale having a vertical dimension extending from a level above said waterline and terminating at a gunwale railing, said gunwale section having a horizontal dimension extending between a bow of said vessel and a fixed gunwale stern end, wherein said fixed gunwale stern end is located forward of said transom, and a deck extending across at least a portion of an interior of said hull;

a sliding gunwale door assembly comprising:

a gunwale sliding door section bound by a sliding section leading edge, a sliding section railing, a sliding section stern edge, and a sliding section base, a first sliding member attached to said gunwale sliding door section, and a second sliding member attached to said deck, wherein said first sliding member slideably engages with said second sliding member;

said gunwale sliding door section being slideably positionable between:

a closed configuration wherein said sliding section leading edge abuts fixed gunwale stern end, and an open configuration wherein said gunwale sliding door section is positioned sternward creating an opening between said sliding section leading edge and said fixed gunwale stern end, wherein in said open configuration, said sliding section stern edge is positioned rearward of said transom;

wherein said gunwale sliding door section has an exterior surface that is continuous with an adjacent exterior surface of said fixed gunwale and wherein said sliding section railing is continuous with said gunwale railing.

8. A marine vessel comprising a gunwale door system as recited in claim 7, said gunwale sliding door section further comprising a sliding member rail cavity, wherein said first sliding member is assembled to said gunwale sliding door section within said sliding member rail cavity.

9. A marine vessel comprising a gunwale door system as recited in claim 7, further comprising a sealing element providing a water barrier between said sliding section leading edge and said fixed gunwale stern end.

10. A marine vessel comprising a gunwale door system as recited in claim 7, further comprising a sliding member support column extending sternward of said fixed gunwale stern end; and a leading edge rabbet formed in said sliding section leading edge, wherein said leading edge rabbet engage with said sliding member support column when said gunwale sliding door section is positioned into a closed configuration.

11. A marine vessel comprising a gunwale door system as recited in claim 7, said gunwale sliding door section further comprising a projecting transom engaging column, wherein projecting transom engaging column aligns and engages with a transom of said vessel when said gunwale sliding door section is positioned into a closed configuration.

12. A marine vessel comprising a gunwale door system as recited in claim 7, said gunwale sliding door section further comprising a skirt on an exterior surface thereof, wherein said skirt conceals said first sliding member.

13. A marine vessel comprising a gunwale door system as recited in claim 7, further comprising a telescopic ladder under said deck.

14. A marine vessel comprising a gunwale door system, the vessel comprising:

a hull comprising:

a displacement hull section extending downward from a waterline, a transom comprising an elongated, generally vertical wall defining a plane that is generally perpendicular to a centerline of said displacement hull section having a substantially vertical and transverse orientation, said transom being located proximate to a stern of said displacement hull section, a fixed gunwale formed about a portion of a peripheral edge of said hull, said fixed gunwale having a vertical dimension extending from a level above said waterline and terminating at a gunwale railing, said gunwale section having a horizontal dimension extending between a bow of said vessel and a fixed gunwale stern end, wherein said fixed gunwale stern end is located forward of said transom, and a deck extending across at least a portion of an interior of said hull;

a sliding gunwale door assembly comprising:

a gunwale sliding door section bound by a sliding section leading edge, a sliding section railing, a sliding section stern edge, and a sliding section base, wherein said sliding section stern edge is located rearward of said transom, a first sliding member attached to said gunwale sliding door section, and a second sliding member attached to said deck, wherein said first sliding member slideably engages with said second sliding member;

said gunwale sliding door section being slideably positionable between:

a closed configuration wherein said sliding section leading edge abuts fixed gunwale stern end, and an open configuration wherein said gunwale sliding door section is positioned sternward creating an opening between said sliding section leading edge and said fixed gunwale stern end;

wherein said gunwale sliding door section has an exterior surface that is continuous with an adjacent exterior surface of said fixed gunwale and wherein said sliding section railing is continuous with said gunwale railing.

15. A marine vessel comprising a gunwale door system as recited in claim 14, said gunwale sliding door section further comprising a sliding member rail cavity, wherein said first sliding member is assembled to said gunwale sliding door section within said sliding member rail cavity.

16. A marine vessel comprising a gunwale door system as recited in claim 14, further comprising a sealing element providing a water barrier between said sliding section leading edge and said fixed gunwale stern end.

17. A marine vessel comprising a gunwale door system as recited in claim 14, further comprising a sliding member support column extending sternward of said fixed gunwale stern end; and a leading edge rabbet formed in said sliding section leading edge, wherein said leading edge rabbet engage with said sliding member support column when said gunwale sliding door section is positioned into a closed configuration.

18. A marine vessel comprising a gunwale door system as recited in claim 14, said gunwale sliding door section further comprising a projecting transom engaging column, wherein projecting transom engaging column aligns and engages with a transom of said vessel when said gunwale sliding door section is positioned into a closed configuration.

19. A marine vessel comprising a gunwale door system as recited in claim 14, said gunwale sliding door section further comprising a skirt on an exterior surface thereof, wherein said skirt conceals said first sliding member.

* * * * *